US010012014B2

(12) United States Patent
Malott et al.

(10) Patent No.: US 10,012,014 B2
(45) Date of Patent: Jul. 3, 2018

(54) HINGE ARRANGEMENT WITH SAG COMPENSATION

(71) Applicant: THE HILLMAN GROUP, INC., Cincinnati, OH (US)

(72) Inventors: Dale G. Malott, Middlebury, IN (US); Gary E. Will, Gold Canyon, AZ (US); Benjamin M. Sandoval, Tempe, AZ (US)

(73) Assignee: THE HILLMAN GROUP, INC., Cincinnati, OH (US)

( * ) Notice: Subject to any disclaimer, the term of this patent is extended or adjusted under 35 U.S.C. 154(b) by 48 days.

(21) Appl. No.: 15/066,530

(22) Filed: Mar. 10, 2016

(65) Prior Publication Data

US 2016/0273251 A1 Sep. 22, 2016

Related U.S. Application Data

(60) Provisional application No. 62/134,230, filed on Mar. 17, 2015.

(51) Int. Cl.

| | |
|---|---|
| ***E05D 7/04*** | (2006.01) |
| ***E05D 5/04*** | (2006.01) |
| ***E05D 11/10*** | (2006.01) |
| ***E05F 1/06*** | (2006.01) |

(Continued)

(52) U.S. Cl.

CPC ..... *E05D 5/04* (2013.01); *E05D 7/04* (2013.01); *E05D 7/0423* (2013.01); *E05D 11/1078* (2013.01); *E05F 1/063* (2013.01); *E05F 1/1215* (2013.01); *E05D 2003/027* (2013.01); *E05D 2007/0484* (2013.01); *E05D 2011/1035* (2013.01); *E05Y 2900/20* (2013.01); *E05Y 2900/40* (2013.01)

(58) Field of Classification Search

CPC ..... E05D 5/04; E05D 7/04; E05D 7/0423; E05D 7/0415; E05F 1/12; E05F 1/1207; E05F 1/1215; E05Y 2900/40; E05Y 2900/402

USPC ..... 16/235, 237, 238, 242, 245–246

See application file for complete search history.

(56) References Cited

U.S. PATENT DOCUMENTS

| | | | | |
|---|---|---|---|---|
| 2,779,966 | A * | 2/1957 | Torchia | E05D 7/0027 16/244 |
| 5,713,105 | A | 2/1998 | Toomey | |
| 6,212,734 | B1 | 4/2001 | Commons | |

(Continued)

*Primary Examiner* — Roberta S Delisle

(74) *Attorney, Agent, or Firm* — Thompson Hine LLP

(57) ABSTRACT

A hinge arrangement includes a first hinge plate assembly including a pivot housing movable about a pivot axis and including a threaded adjustment pin transverse to the pivot axis away from the housing. A second hinge plate assembly includes an adjustment housing, the adjustment housing including a threaded portion. The threaded adjustment pin is threaded into the adjustment housing to connect the first hinge plate assembly to the second hinge plate assembly. Relative rotation between the threaded adjustment pin and the threaded portion of the adjustment housing causes the second hinge plate assembly to move along a length of the threaded adjustment pin, altering a spacing between a mount plate portion of the first hinge plate assembly and a mount plate portion of the second hinge plate assembly. A connection between the pivot housing and the first hinge plate assembly may include a torsional and/or gravity closing bias.

26 Claims, 21 Drawing Sheets

(51) Int. Cl.
*E05F 1/12* (2006.01)
*E05D 3/02* (2006.01)

(56) References Cited

U.S. PATENT DOCUMENTS

| | | | | |
|---|---|---|---|---|
| D443,196 | S | 6/2001 | Sosa | |
| 7,240,400 | B2 | 7/2007 | Bonham | |
| 7,269,880 | B2 | 9/2007 | Wallis et al. | |
| 7,587,788 | B2 | 9/2009 | Heid | |
| D624,388 | S | 9/2010 | Eland | |
| 7,895,713 | B2 | 3/2011 | Williams, Jr. | |
| 8,245,353 | B2 | 8/2012 | Homner et al. | |
| 8,375,517 | B1 | 2/2013 | Johnsen | |
| 8,381,356 | B2 | 2/2013 | Chen | |
| 8,448,297 | B2 | 5/2013 | Chen | |
| 8,631,542 | B2 | 1/2014 | Chen | |
| 8,745,820 | B2 | 6/2014 | Janak | |
| 8,800,109 | B1 | 8/2014 | Mitchell et al. | |
| 8,966,713 | B1 | 3/2015 | Russo et al. | |
| 8,991,009 | B1 | 3/2015 | Russo et al. | |
| 9,033,907 | B2 | 5/2015 | Noble | |
| 9,038,242 | B2 | 5/2015 | Chung | |
| 2004/0093689 | A1* | 5/2004 | Sosa | E05D 7/04 16/301 |
| 2005/0183238 | A1 | 8/2005 | McCue et al. | |

* cited by examiner

HINGE ARRANGEMENT WITH SAG COMPENSATION

CROSS-REFERENCES

This application claims the benefit of U.S. provisional application Ser. No. 62/134,230, filed Mar. 17, 2015, which is incorporated herein by reference.

TECHNICAL FIELD

This application relates generally to hinges and, more specifically, to a hinge arrangement that provides for adjustment for purpose of alignment and/or in the event of sag over time (e.g., as can be experienced in the case of heavy doors or gates such as large, outdoor gates).

BACKGROUND

In the case of gate hinge systems, gates may be prone to sag due to the size and weight of the gate and/or the materials used for gate construction. Moreover, when installing gate hinge systems achieving desired alignment, uniformity of gaps and proper latch engagement can be difficult. Attempt have been made in the past to address these concerns by providing adjustable hinge assemblies. However, such adjustable hinge assemblies tend to be overly complicated and/or require special tools for adjustment and/or do not adequately account for the impact of weather on threaded components and/or have not incorporated other desirable features for gate hinges.

Accordingly, it would be desirable to provide a gate hinge arrangement that is capable of adjustment to compensate for gate sag over time and/or that facilitates alignment and/or installation, while at the same time addressing one or more problems encountered with prior art adjustable hinges.

SUMMARY

Gate hinge arrangements permit adjustment for gate sag over time and may include a stabilizing feature.

In one aspect, a hinge arrangement includes a first hinge plate assembly including a pivot housing thereon movable about a pivot axis, the pivot housing including a threaded adjustment pin extending in a direction transverse to the pivot axis away from the pivot housing. A second hinge plate assembly includes an adjustment housing thereon, the adjustment housing including a threaded portion. The threaded adjustment pin is threaded into the adjustment housing to connect the first hinge plate assembly to the second hinge plate assembly. Relative rotation between the threaded adjustment pin and the threaded portion of the adjustment housing causes the second hinge plate assembly to move along a length of the threaded adjustment pin thereby altering a spacing between a mount plate portion of the first hinge plate assembly and a mount plate portion of the second hinge plate assembly. A portion of the threaded adjustment pin extending between the pivot housing and the adjustment housing is unthreaded and the adjustment housing substantially surrounds a threaded portion of the threaded adjustment pin to protect the threaded portion against weather related corrosion.

In another aspect, a hinge arrangement includes a first hinge plate assembly including a pivot housing thereon movable about a pivot axis, the pivot housing including a threaded adjustment pin extending in a direction transverse to the pivot axis away from the pivot housing. A second hinge plate assembly includes an adjustment housing thereon, the adjustment housing including a threaded portion. The threaded adjustment pin is threaded into the adjustment housing to connect the first hinge plate assembly to the second hinge plate assembly. Relative rotation between the threaded adjustment pin and the threaded portion of the adjustment housing causes the second hinge plate assembly to move along a length of the threaded adjustment pin thereby altering a spacing between a mount plate portion of the first hinge plate assembly and a mount plate portion of the second hinge plate assembly. A connection between the pivot housing and the first hinge plate assembly includes a gravity hinge feature.

In a further aspect, a hinge arrangement includes a first hinge plate assembly including a pivot housing thereon movable about a pivot axis, the pivot housing including a threaded adjustment pin extending in a direction transverse to the pivot axis away from the pivot housing. A second hinge plate assembly includes an adjustment housing thereon, the adjustment housing including a threaded portion. The threaded adjustment pin is threaded into the adjustment housing to connect the first hinge plate assembly to the second hinge plate assembly. Relative rotation between the threaded adjustment pin and the threaded portion of the adjustment housing causes the second hinge plate assembly to move along a length of the threaded adjustment pin thereby altering a spacing between a mount plate portion of the first hinge plate assembly and a mount plate portion of the second hinge plate assembly. The pivot housing includes upper and lower support structures that extend respectively along upper and lower portions of the adjustment housing.

The details of one or more embodiments are set forth in the accompanying drawings and the description below. Other features, objects, and advantages will be apparent from the description and drawings, and from the claims.

DETAILED DESCRIPTION

Figure 1:
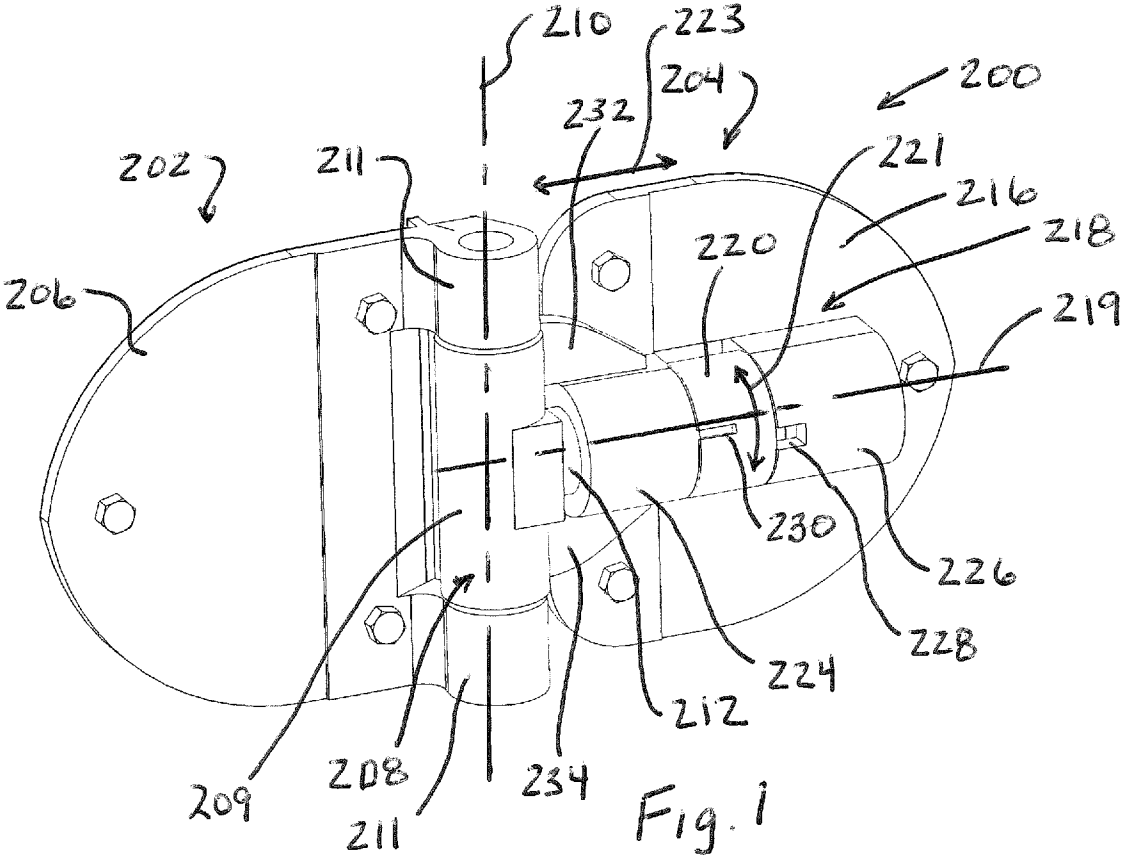
FIG. 1 shows a perspective front view of one embodiment of a hinge arrangement.

Referring now to FIGS. 1-7, a hinge arrangement 200 is shown and includes a hinge plate assembly 202 and a hinge plate assembly 204. Hinge plate assembly 202 includes a mount plate portion 206 and a pivot housing 208 thereon movable about a pivot axis 210. The pivot housing 208 includes a cylindrical body 209 aligned about the axis 210 and an externally threaded adjustment pin 212 extending in a direction transverse (e.g., perpendicular) to the pivot axis 210. The cylindrical body 209 is positioned between end hinge bodies 211 (e.g., hinge barrels) that are integral with or fixed to plate portion 206, with the openings in end hinge bodies 211 and cylindrical body 209 aligned for receipt of a vertical hinge pin (not shown). The adjustment pin 212 is movable with the pivot housing 208 as the pivot housing rotates about the axis 210, but the adjustment pin 212 does not rotate relative to the pivot housing (e.g., the threaded adjustment pin 212 has an elongated axis 219 about which the threaded adjustment pin 212 does not rotate). Thus, the pin 212 and pivot housing 208 may be formed as a single component or part, although formation as multiple components that are interconnected is also possible.

Hinge plate assembly 204 includes a mount plate portion 216 with an adjustment housing 218 thereon, at least a portion of which is threaded. In the illustrated example, an internally threaded central portion 220 of the adjustment housing 218 is rotatable about the elongated axis 219 (e.g., in either direction per arrow 221) for purpose of hinge adjustment (e.g., adjusting a lateral position of hinge plate assembly 204 relative to hinge plate assembly 202 per arrow 223). In particular, the threaded portion 220 of the adjustment housing may take the form of a nut-type component that is positioned in a space 222 (FIG. 4) between adjacent fixed portions 224 and 226 of the adjustment housing 218. The externally threaded end portion 212*a* (FIG. 5) of the adjustment pin 212 extends from an initial unthreaded portion 212*b*, with threaded end portion 212*a* engaging with the internal threads of the housing portion 220. Thus, rotation of the housing portion 220 causes hinge plate assembly 204 to move toward or away from hinge plate assembly 202, depending upon the rotation direction. In this regard, portion 220 may include slots 230 that can be engaged by a tool (e.g., a flat head screwdriver) to facilitate rotation. In the illustrated embodiment, a plurality (e.g., 2 or more, such as 3 or more) of spaced apart slots are disposed around a periphery of the nut-type component 220, thereby assuring access to at least one of the slots regardless of the rotation position of the component 220.

Figure 2:
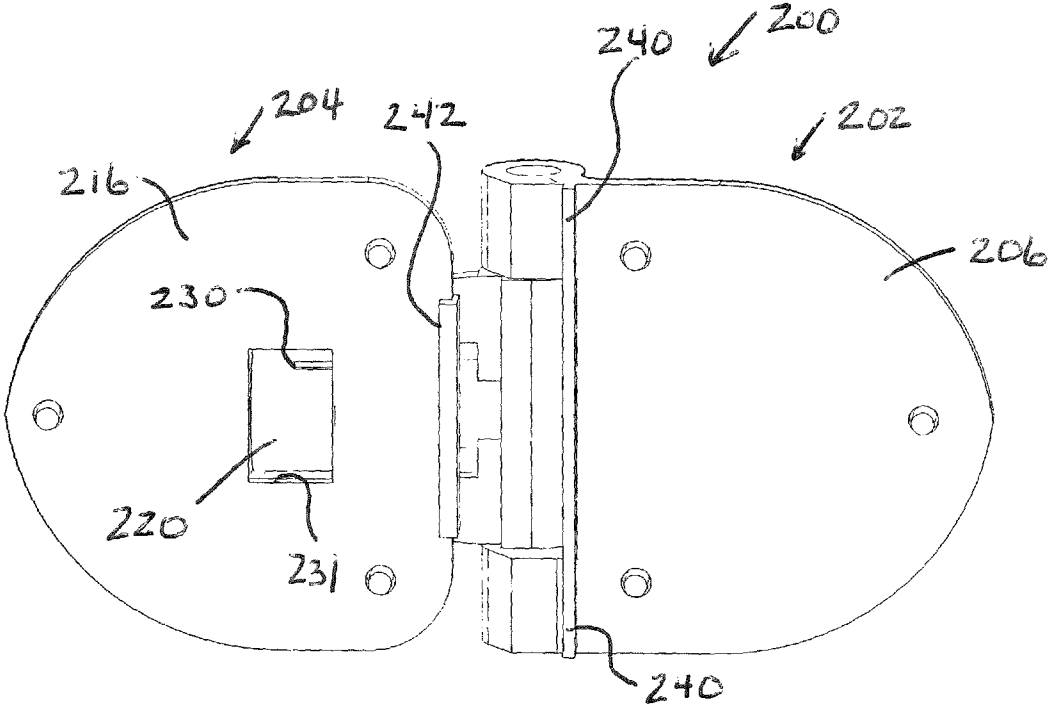
FIG. 2 is a perspective rear view of the hinge arrangement of FIG. 1.
Figure 4:
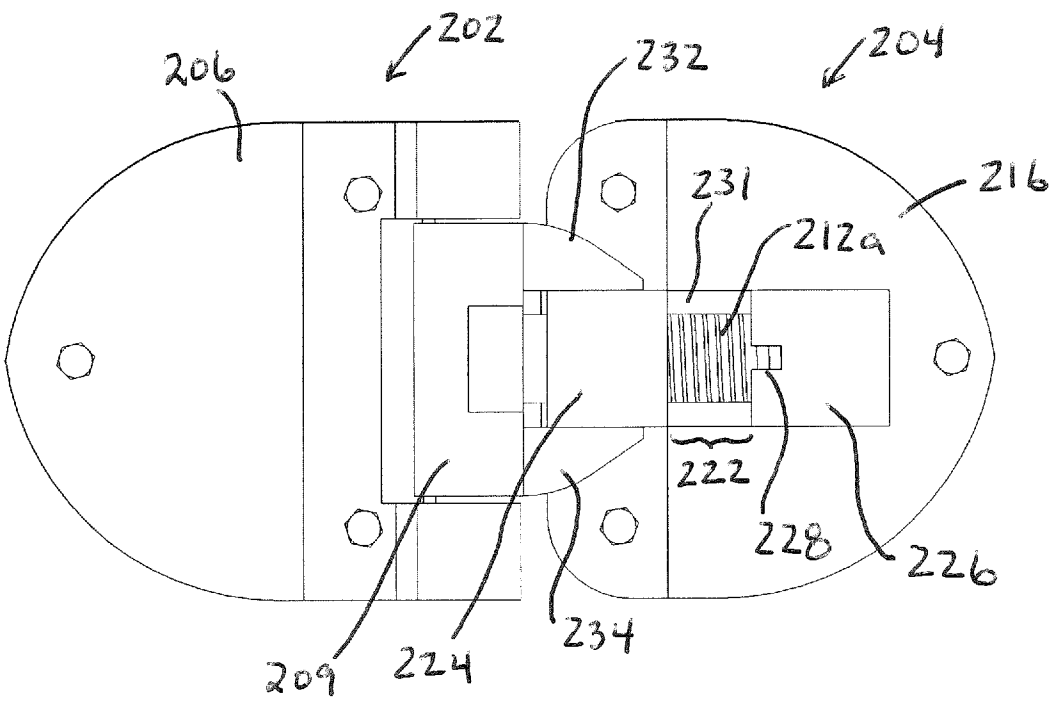
FIG. 4 shows the elevation view of FIG. 3 with the adjustment nut housing portion removed.
Figure 5:
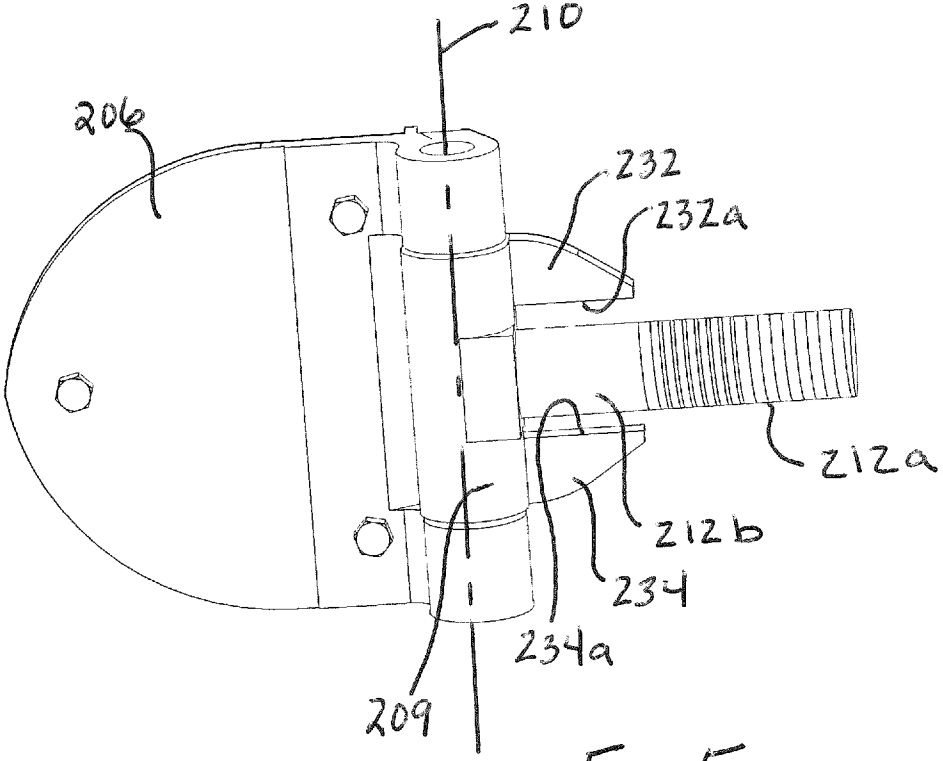
FIG. 5 is a perspective view of one hinge plate assembly of the hinge arrangement of FIG. 1.
Figure 6:
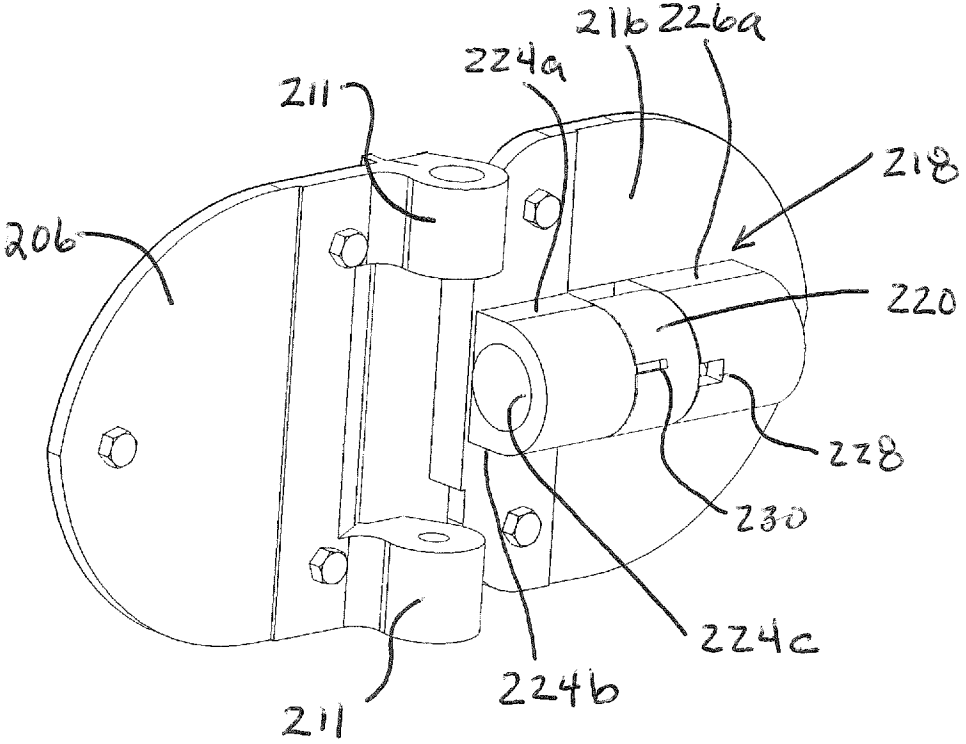
FIG. 6 is a perspective view of the hinge arrangement of FIG. 1 with pivot housing removed.

The plate portion 216 may include an opening 231 that allows the rotatable housing portion component 220 to sit low against the plate portion 216 as shown best in FIGS. 2 and 4. Fixed portions 224 and 226 of the adjustment housing need not have any internal threads, and have through openings (e.g., 224*c* in FIG. 6) that are sized to permit the adjustment pin to move along the passage in each portion during rotation of component 220.

Notably, housing portion 226 includes a slot 228 that enables viewing internal of the housing 226. The slot is provided to enable a user to determine whether the end of the adjustment pin has passed fully through housing portion 220 as is desired to assure a stable and solid connection between the two hinge plate assemblies (e.g., see FIG. 3 where the internal threaded portion of the adjustment pin 212 can be seen through the slot 228). As best reflected by the views of FIGS. 1 and 3, the adjustment housing 218 substantially surrounds the threaded portion of the threaded adjustment pin to protect the threaded portion against weather related corrosion. A substantial majority (e.g., 75% or more) of the unthreaded portion of the adjustment pin may also be contained within the adjustment housing 218, creating a clean look, with a distal end of the threaded adjustment pin 212 terminating within the adjustment housing 226.

Figure 14:
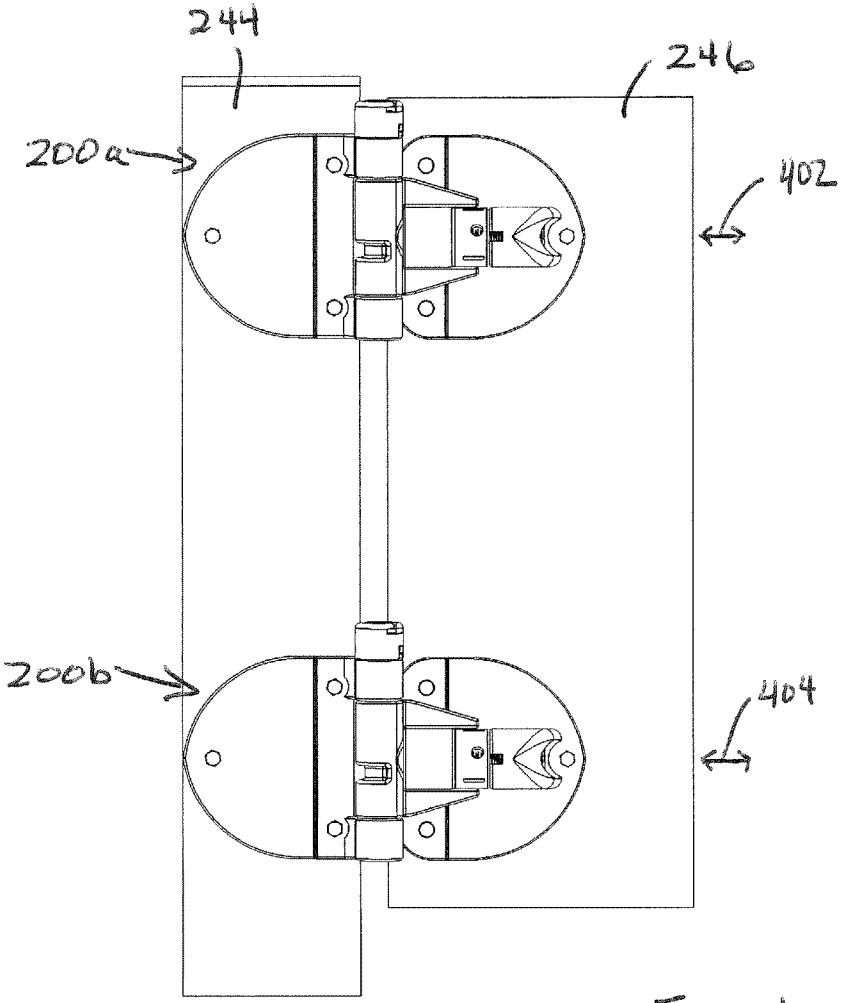
FIGS. 14 and 15 show front and side views respectively of a pair of hinge arrangements attached to a gate and post.
Figure 15:
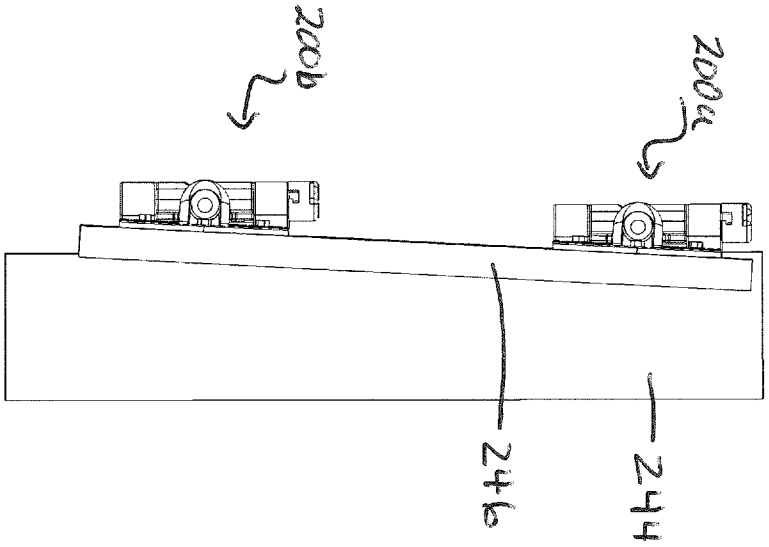
Figure 16:
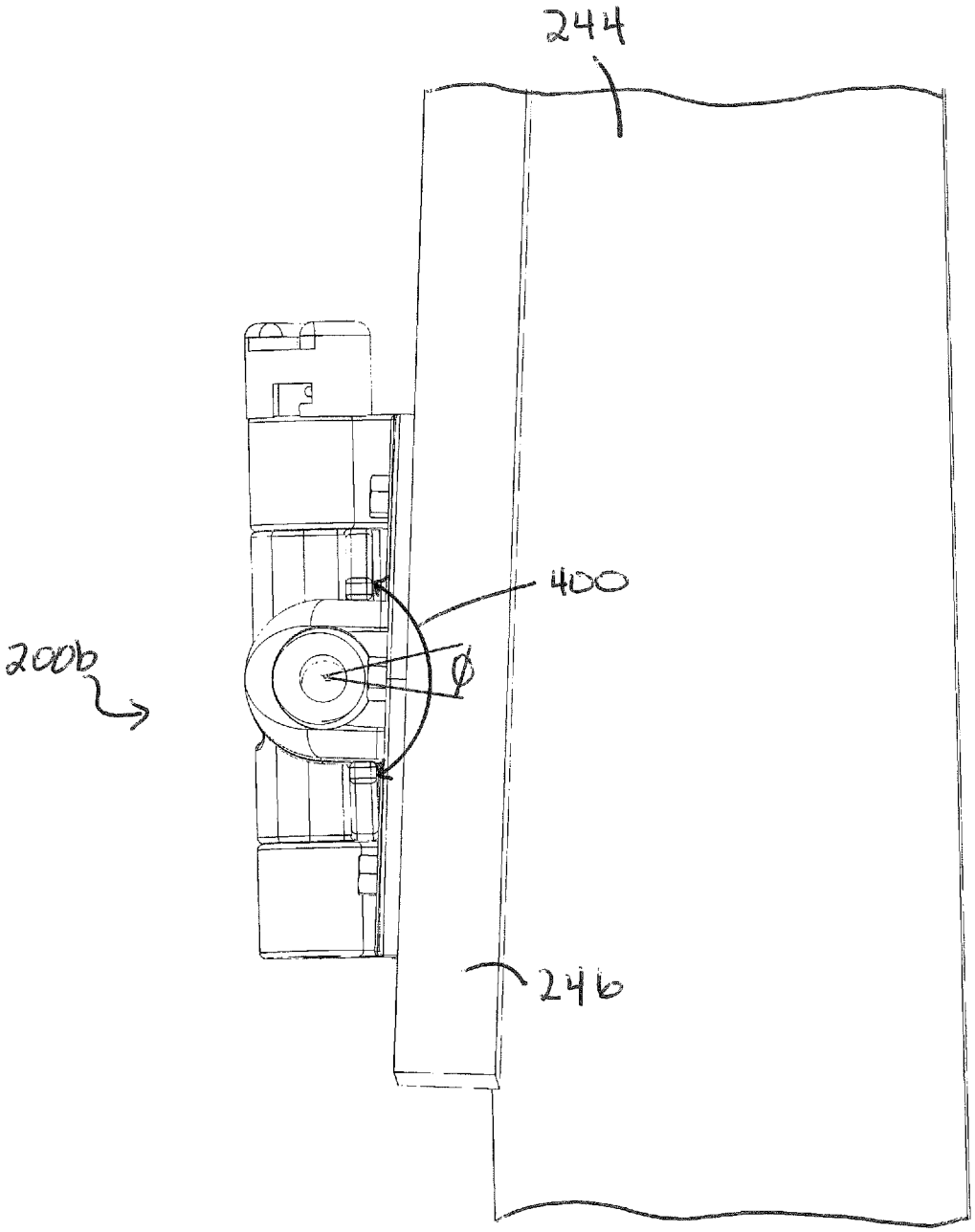
FIG. 16 shows an enlarged side view of one hinge arrangement of FIG. 15.
Figure 17:
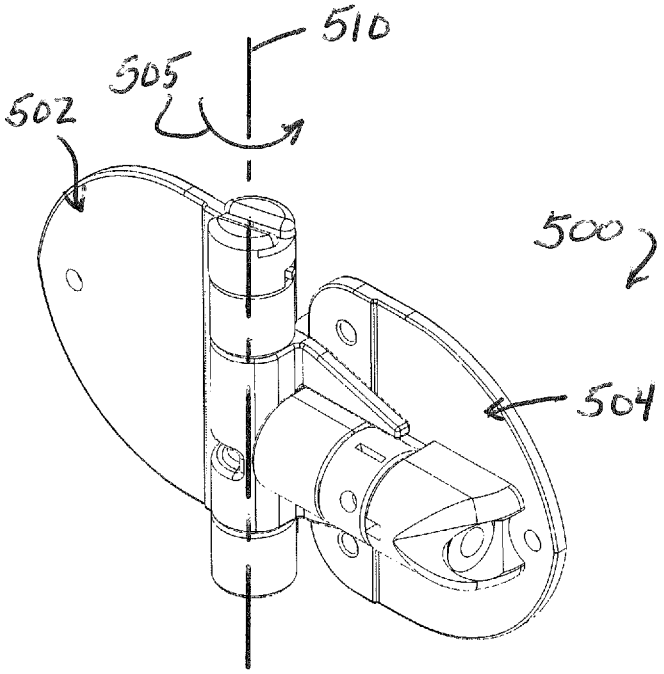
FIGS. 17-21 show another embodiment of a hinge arrangement with a spring bias feature.
Figure 18:
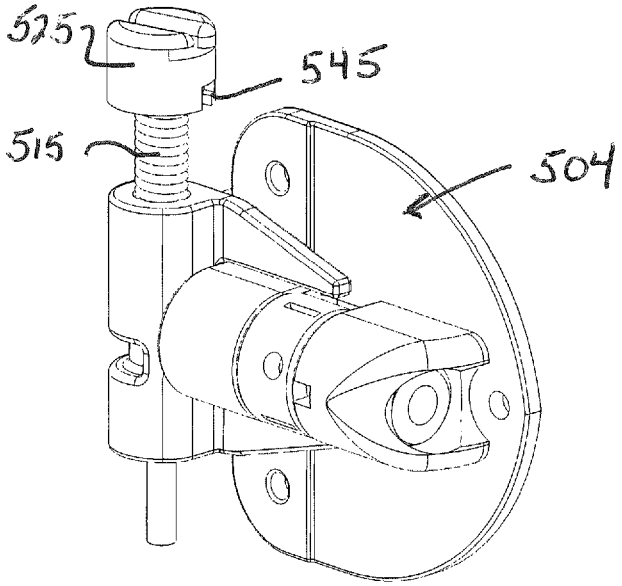
Figure 19:
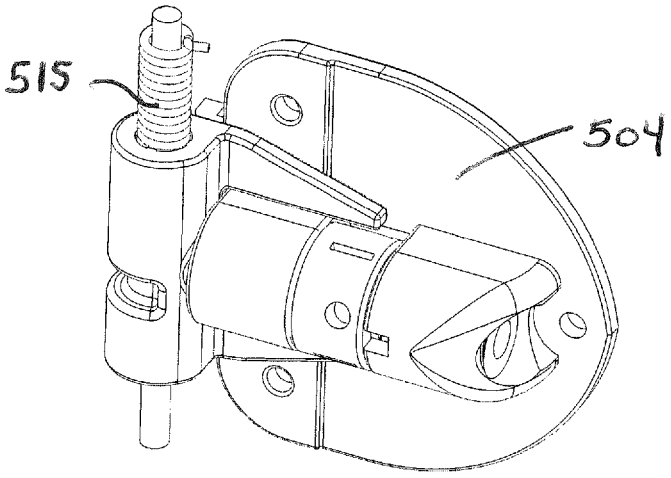
Figure 20:
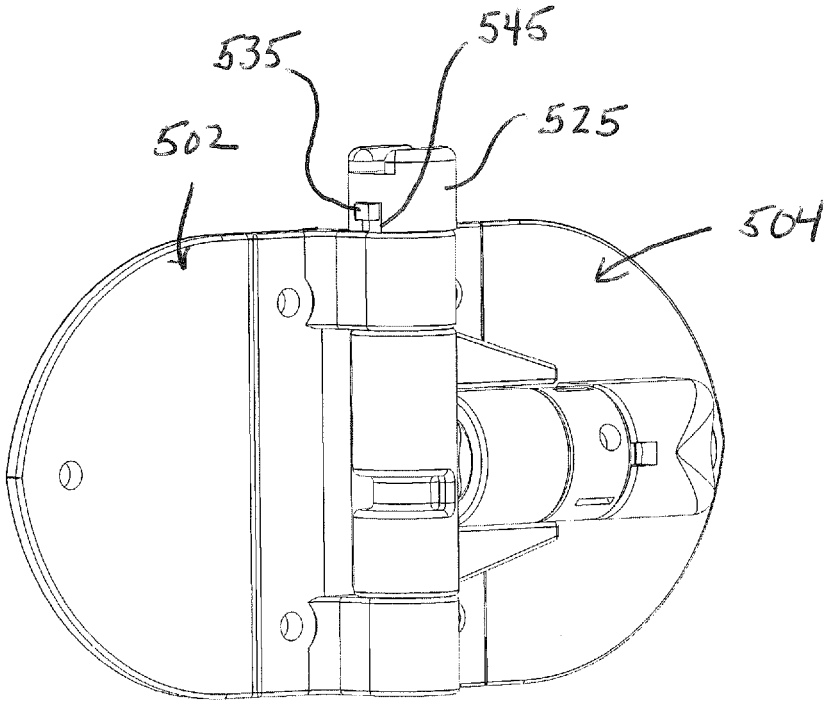
Figure 21:
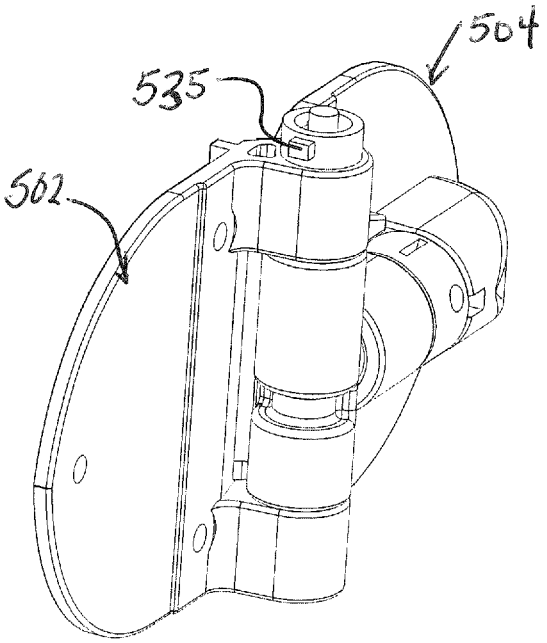

The pivot housing 208 may also include additional support structure such as upper and lower bracket parts 232 and 234 that run along the top and bottom portions of the fixed housing portion 224 (e.g., in contact or near contact). In the illustrated embodiment, each bracket part 232, 234 is of a planar plate configuration that tapers so as to have a reduced vertical dimension when moving away from the cylindrical body 209. Each bracket part also includes a respective flats 232*a*, 234*a* (FIG. 5) that face the adjustment pin 212 and thus, when the two plate assemblies are connected, the adjustment housing (not shown in FIG. 5). The upper and lower portions of the adjustment housing include respective corresponding flats (e.g., 224*a*, 224*b* and 226*a* in FIG. 6) that face the flats 232*a* and 234*b*. A close fit relationship may be provided so that the facing flats are in contact with each other, but variations with small gaps between the facing flats are also possible. The rear face of each bracket part 232, 234 faces the front face of plate portion 216, with a small gap provided therebetween, as best seen in the top view of FIG. 7 where rear face 232*b* is slightly spaced from front face 216*a*. As best seen in FIGS. 14-16, this positioning of the brackets 232, 234 allows for some rotation of the hinge plate assembly 204 (relative to hinge plate assembly 202) during installation and assembly of the hinges on a post 244 and gate 246 structure. In particular, if an upper hinge arrangement 200*a* and lower hinge arrangement 200*b* are both attached to the post 244, and the upper hinge arrangement 200*a* has also been attached to the gate 246, the hinge plate assemblies 204 can pivot slightly (e.g., per pivot path 400 in FIG. 16) to enable as necessary in the event of the gate bottom misaligning (e.g., moving forward or rearward relative to the post 244 for tilt compensation), without damage to the upper hinge arrangement 200*a*, so as to enable the lower hinge arrangement 200*b* to be attached to the gate 246. At the same time, the interaction between the brackets 232, 234 and the plate portion 216 will limit the amount of pivot, such as between an angle Φ of between about two degrees and about five degrees. Other support structure configurations are also possible as alternatives to the brackets 232, 234. For example, the housing portion 224 could include upper and lower slots into which the bracket parts 232, 234 fit and slide during hinge adjustment. Likewise, the housing portion 224 could include protruding rails that fit into slots on the bracket parts 232 and 234.

Figure 7:
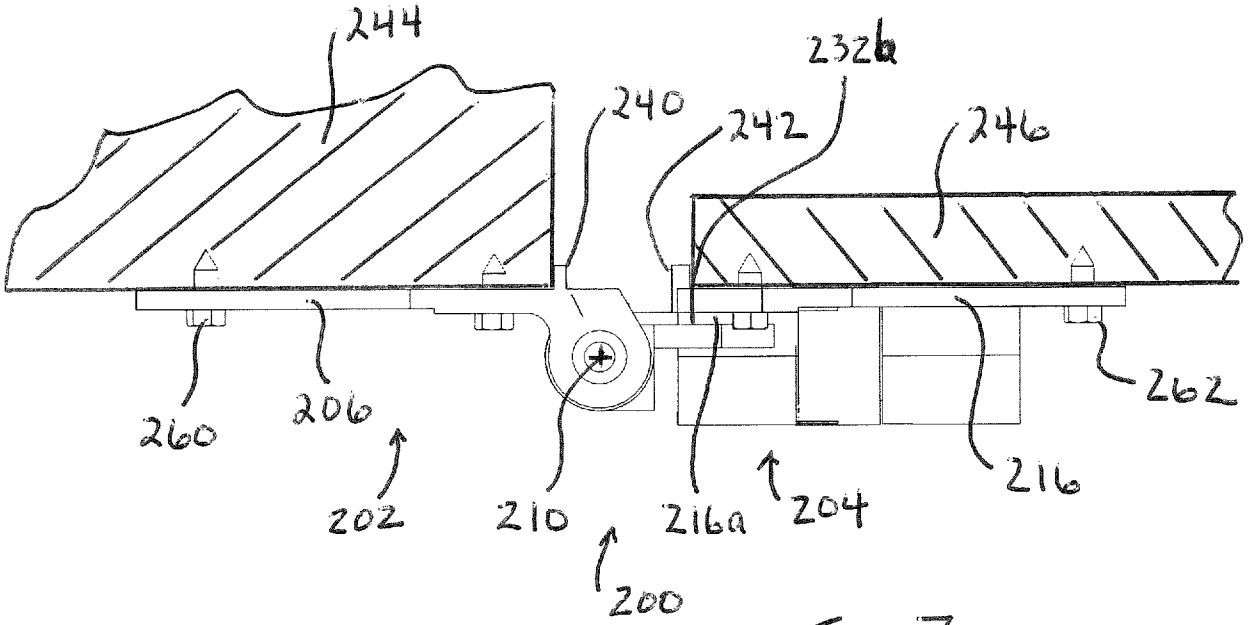
FIG. 7 is a top elevation view of the hinge arrangement of FIG. 1 mounted on a post and gate.
Figure 8:
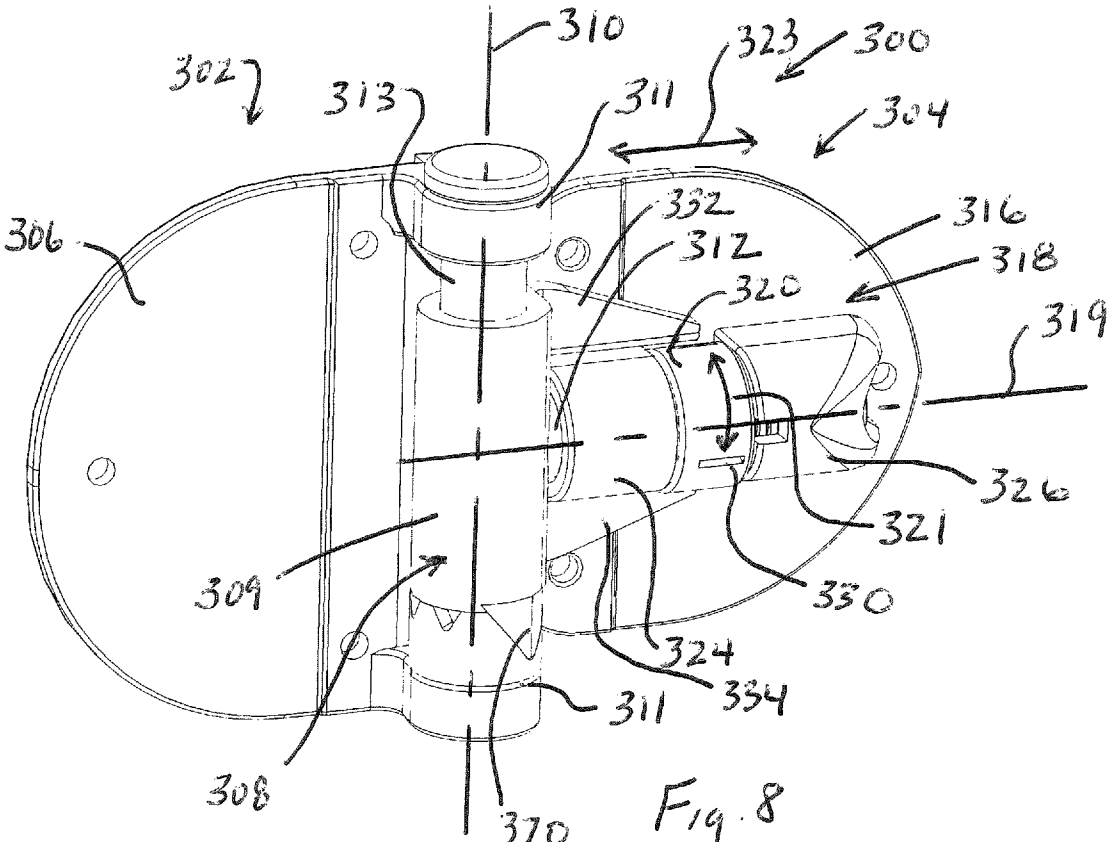
FIG. 8 shows a perspective front view of another embodiment of a hinge arrangement in a gate/door closed orientation.

In an exemplary installation, per FIG. 7, the mount plate portion 206 of hinge plate assembly 202 is connected to a gate post 244 and the mount plate portion 216 of the hinge plate assembly 204 is connected to a gate 246 (e.g., in each case by fasteners such as screws 260, 262), enabling the gate to swing relative to the post about pivot axis 210. Typically, at least two instances of the hinge arrangement 200 would be installed in a vertically spaced apart manner to support the gate 246 on the post 244, as per FIG. 14, enabling lateral adjustment of the position of the gate 246 relative to the post 244 at each hinge element per arrows 402 and 404 (e.g., as desired for aligning the free side of the gate with a latch system on another post, or for creating more uniform gaps between the sides of the gate and the posts).

As seen in FIGS. 2 and 7, the plate portions 206 and 216 may include locating features (e.g., protruding rails 240 and 242) to align each plate with a respective corner edge of the post 244 or gate 246. While the described embodiment focuses on outdoor gates attached to posts, it is recognized that the hinge arrangement could be used on other structures, such as indoor gates or interior or exterior doors (e.g., where structure 244 could be a door jamb and structure 246 a door) or doors on appliances, furniture, cabinetry etc.

Figure 3:
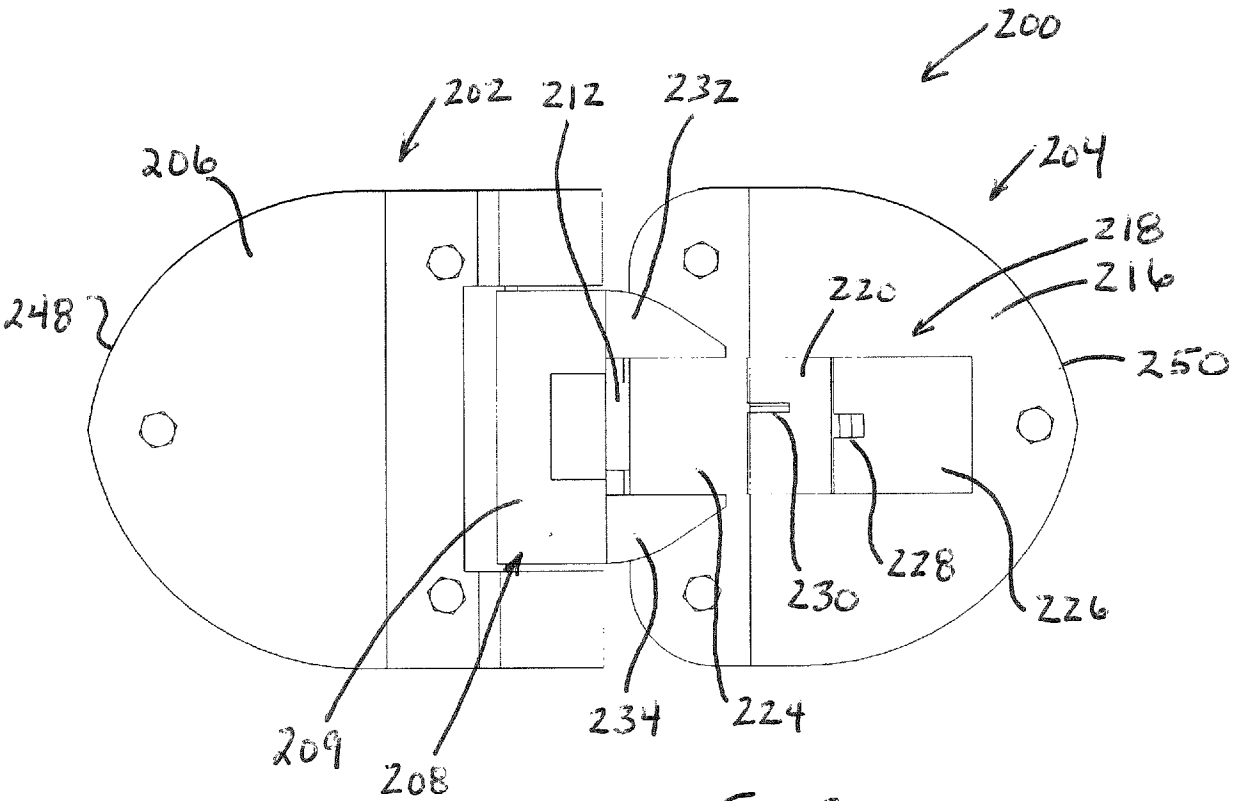
FIG. 3 is a front elevation view of the hinge arrangement of FIG. 1.

As best seen in FIG. 3 the lateral perimeters 248 and 250 of the plate portions 206 and 208 may be made with curvature and or irregular (e.g., without any substantial linear up and down segments) to help mask any offset of the hinge plate portions from vertical.

Frictional resistance may be added between components 212 and 220 to oppose undesired rotation/adjustment from vibration. For example, the thread configuration (e.g., conventional, square, tri-lobe) could provide for some interference or some additional structure could be added for interference. Other interference structure could also be used to inhibit vibratory rotation of housing nut portion 220.

Referring now to FIGS. 8-13, an alternative hinge arrangement 300 with many similarities to hinge plate assembly 200 above. In particular, hinge arrangement 300 includes a hinge plate assembly 302 and a hinge plate assembly 304. Hinge plate assembly 302 includes a mount plate portion 306 and a pivot housing 308 thereon movable about a pivot axis 310. The pivot housing 308 includes a cylindrical body 309 aligned about the axis 310 and an externally threaded adjustment pin 312 extending in a direction transverse (e.g., perpendicular) to the pivot axis 310. The cylindrical body 309 is positioned between end hinge bodies 311 that are integral with or fixed to plate portion 306, with the openings in end hinge bodies 311 and cylindrical body 309 aligned for receipt of a vertical hinge pin 313. The adjustment pin 312 is movable with the pivot housing 308 as the pivot housing rotates about the axis 310, but the adjustment pin 312 does not rotate relative to the pivot housing (e.g., the threaded adjustment pin 312 has an elongated axis 319 about which the threaded adjustment pin 312 does not rotate). Thus, the pin 312 and pivot housing 308 may be formed as a single component or part, although formation as multiple components that are interconnected is also possible.

Hinge plate assembly 304 includes a mount plate portion 316 with an adjustment housing 318 thereon, at least a portion of which is threaded. In the illustrated example, an internally threaded central portion 320 of the adjustment housing 318 is rotatable about the elongated axis 319 (e.g., in either direction per arrow 321) for purpose of hinge adjustment (e.g., adjusting a lateral position of hinge plate assembly 304 relative to hinge plate assembly 302 per arrow 323). In particular, the threaded portion 320 of the adjustment housing may take the form of a nut-type component that is positioned in a space 322 (FIG. 12) between adjacent fixed portions 324 and 326 of the adjustment housing 318. The externally threaded end portion 312*a* (FIG. 13) of the adjustment pin 312 extends from an initial unthreaded portion 312*b*, with threaded end portion 312*a* engaging with the internal threads of the housing portion 320. Thus, rotation of the housing portion 320 causes hinge plate assembly 304 to move toward or away from hinge plate assembly 302, depending upon the rotation direction. In this regard, portion 320 may include slots 330 that can be engaged by a tool (e.g., a flat head screwdriver) to facilitate rotation. In the illustrated embodiment, a plurality (e.g., 2 or more, such as 3 or more) of spaced apart slots are disposed around a periphery of the nut-type component 320, thereby assuring access to at least one of the slots regardless of the rotation position of the component 320. Housing portion 326 includes a slot 328 that enables viewing internal of the housing 326 (e.g., for use in verifying location of the adjustment pin).

The pivot housing 308 also includes additional support structure such as upper and lower bracket parts 332 and 334 that run along the top and bottom portions of the fixed housing portion 324 (e.g., in contact or near contact). Bracket parts 332 and 334 may interact with housing portions 324 and 326 in a manner similar to that described above for bracket parts 232 and 234 and housing portions 224 and 226.

Figure 9:
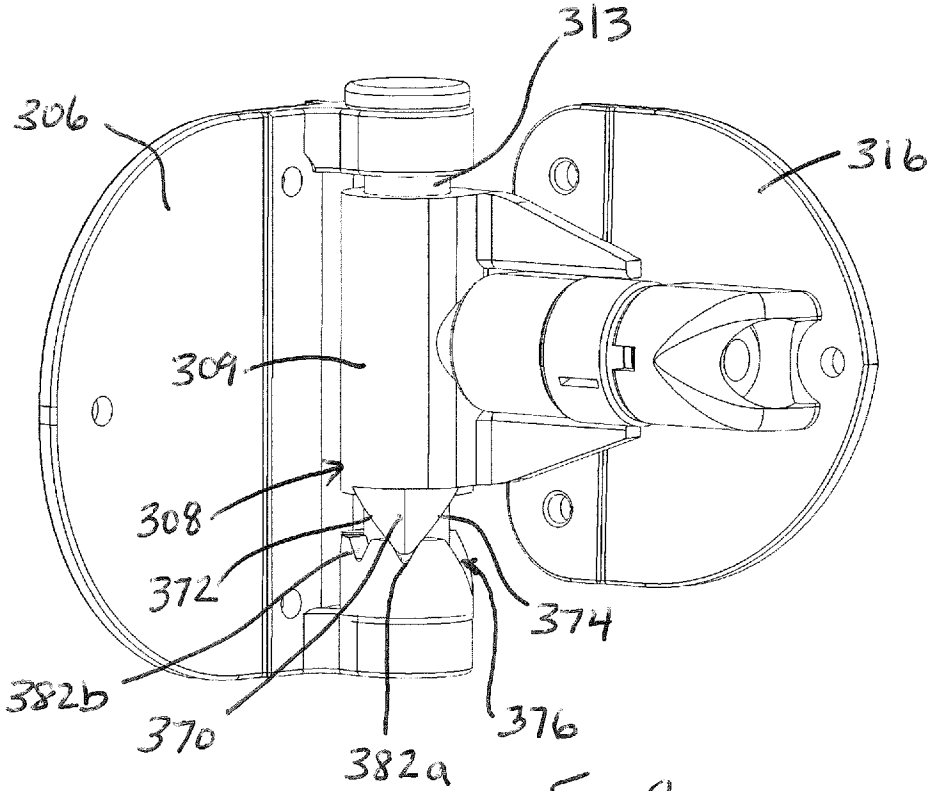
FIG. 9 shows a perspective view of the hinge arrangement of FIG. 8 in one gate/door open orientation.
Figure 10:
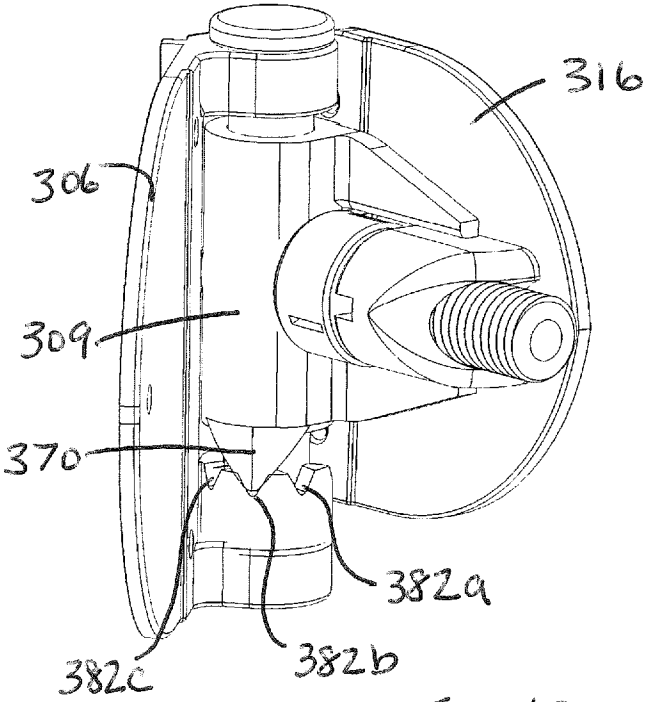
FIG. 10 shows a perspective view of the hinge arrangement of FIG. 8 in another gate/door open orientation.
Figure 11:
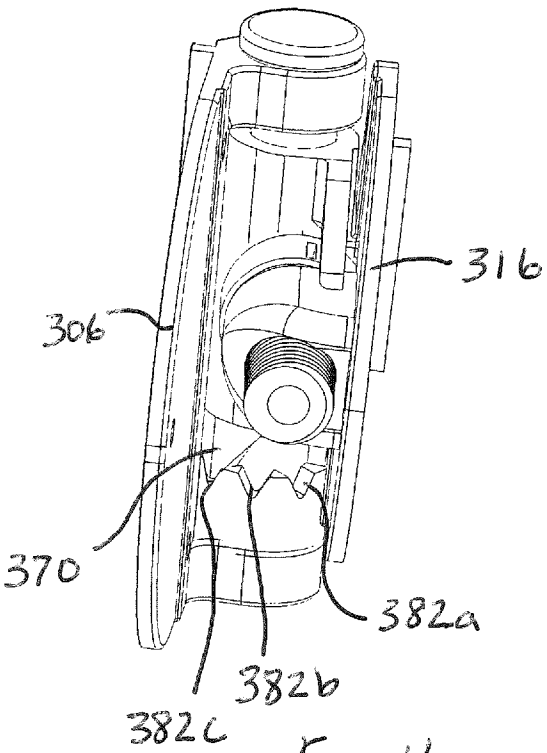
FIG. 11 shows a perspective view of the hinge arrangement of FIG. 8 in yet another gate/door open orientation.
Figure 12:
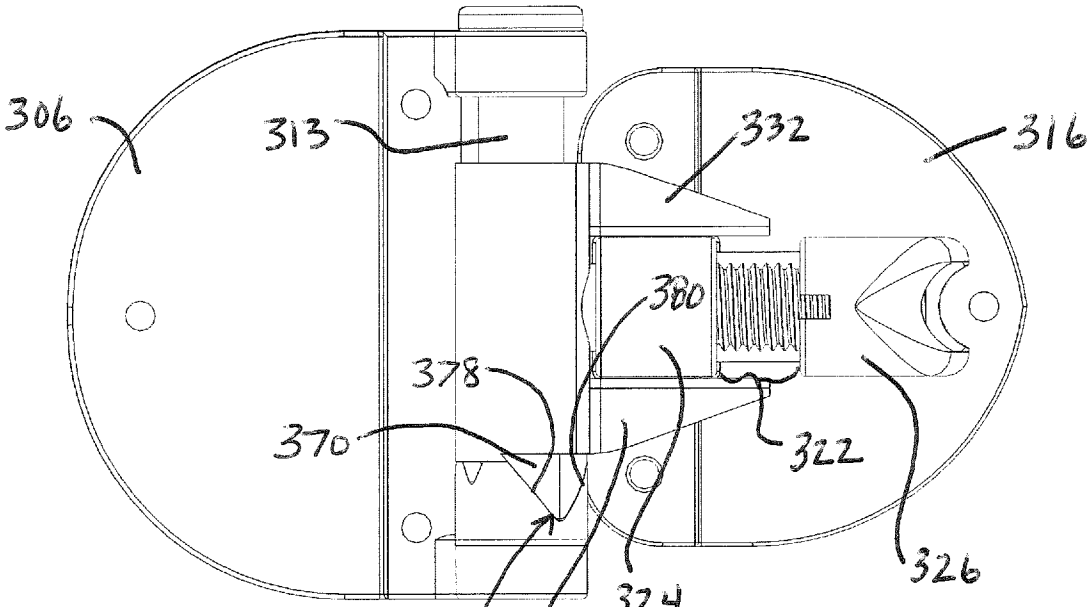
FIG. 12 is a front elevation view of the hinge arrangement of FIG. 8 with the adjustment nut housing portion removed.
Figure 13:
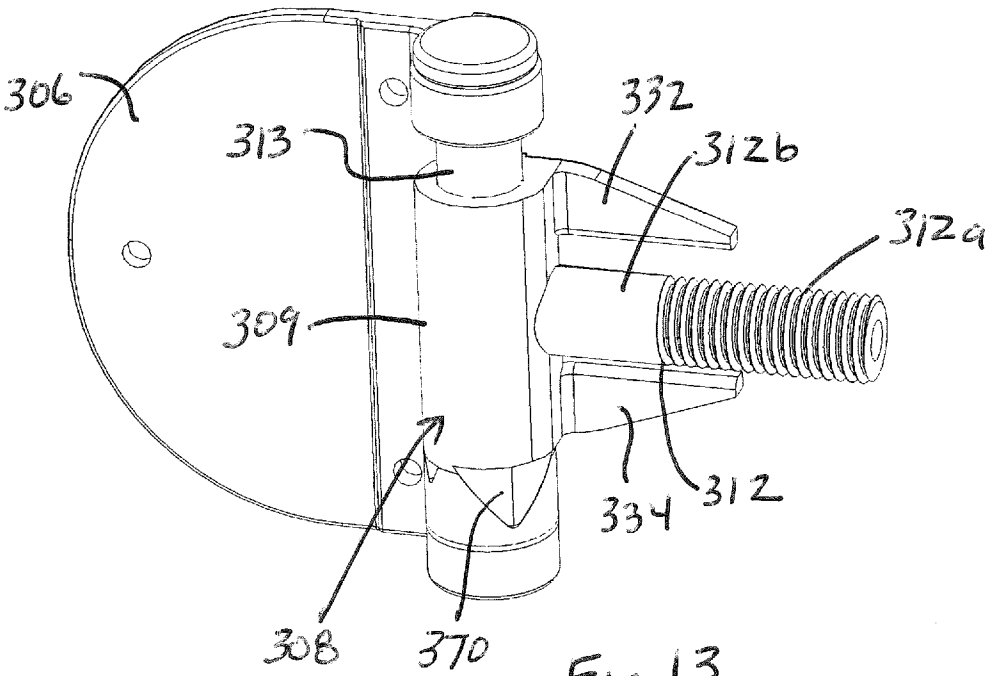
FIG. 13 is a perspective view of one hinge plate assembly of the hinge arrangement of FIG. 8.

A primary difference between hinge arrangement 300 and hinge arrangement 200 is that in the hinge arrangement 300 a connection between the pivot housing 308 and the hinge plate assembly 304 includes a gravity hinge feature. In particular, as best seen in FIG. 9 the lower portion of the cylindrical body 309 includes a downward part-cylindrical projection 370 that defines oppositely angles surfaces 372, 374, and the upper portion of the lower end hinge body 311 includes a primary seating notch 376 with oppositely angled surfaces 378 and 380 (FIG. 12). When the hinge is in the gate/door closed position (e.g., FIGS. 8 and 12) the projection 370 seats within the notch 376, with the interacting surfaces 372, 374 and 378, 380 operating to provide some resistance against pivotal movement of the hinge plate assembly 304 out of the gate/door closed position. When the hinge plate assembly 304 is rotated toward a gate/door open position, the surfaces 372 and 378 interact in a cam action to lift the pivot housing 308 upward along the hinge pin 313 (e.g., thereby slightly raising any gate/door to which hinge plate assembly 304 is attached). When the hinge plate assembly 304 is again rotated toward the gate/door closed position, the surfaces 373 and 378 interact in a gravity induced cam action to force the hinge plate assembly 304 into the gate/door closed position.

Notably, the upper portion of the lower end hinge body 311 also includes a plurality of detent notches into which the projection may seat to hold the hinge plate assembly 304 (and the gate/door to which it is attached) in an open position. As reflected in FIGS. 9-11, multiple detents 382*a*, 382*b* and 382*c* may be provided. In each detent position the force of gravity acting downward on hinge plate assembly 304 causes the projection 370 and detent to interact in a manner that tends to prevent the hinge plate assembly 304 from rotating unless sufficient force is applied to overcome the resistance created by the engaged projection and detent.

The various hinge arrangements could be made of any suitable material or combinations of materials (e.g., entirely of metal or entirely of engineered resins/plastics). The adjustment pins and adjustment nuts may typically be formed of stainless steel or as steel inserts into plastic, but variations are possible.

The hinge arrangements could also include torsion springs or other biasing means to bias the hinge arrangements toward open or closed conditions or to dampen hinge pivot (e.g., as an alternative to the gravity hinge arrangement and gravity detents described above). In this regard, reference is made to FIGS. 17-21 showing a hinge arrangement 500 with many features similar to that of the above hinge arrangements. However, hinge arrangement 500 with hinge plate assemblies 502 and 504 includes a torsion spring arrangement to rotational urge hinge plate assembly 504 about hinge axis 510 in the direction of arrow 505 (e.g., in the gate/door closed direction). The torsion spring 515 is internal of the hinge components and a spring cap 525 covers the top of the spring. When the cap is partially raised, it can be used to rotate the upper end of the spring 515 in either direction to either increase or decrease the bias provided by the spring (e.g., where a free end of the wire forming the spring is carried in a slot 545 of the cap during the adjustment). When fully seated/lowered, the cap can engage with a rotation preventing tab 535 of the hinge plate assembly 502.

It is to be clearly understood that the above description is intended by way of illustration and example only, is not intended to be taken by way of limitation, and that other changes and modifications are possible. For example, the gravity feature could be combined with a spring feature (e.g., a compression spring that urges projection 370 into notch 376, or a spring the tends to push projection 370 out of the notch 376). Moreover, while the gate post type structure is shown on the left side and the gate/door type structure is shown on the right side in the drawings above, it is recognized that the opposite orientation is possible.

What is claimed is:

1. A hinge arrangement, comprising:

a first hinge plate assembly including a pivot housing thereon movable about a pivot axis, the pivot housing including a threaded adjustment pin extending in a direction transverse to the pivot axis away from the pivot housing;

a second hinge plate assembly including an adjustment housing thereon, the adjustment housing including a threaded portion;

wherein the threaded adjustment pin is threaded into the adjustment housing to connect the first hinge plate assembly to the second hinge plate assembly, wherein relative rotation between the threaded adjustment pin and the threaded portion of the adjustment housing causes the second hinge plate assembly to move along a length of the threaded adjustment pin thereby altering a spacing between a mount plate portion of the first hinge plate assembly and a mount plate portion of the second hinge plate assembly; and wherein a portion of the threaded adjustment pin extending between the pivot housing and the adjustment housing is unthreaded and the adjustment housing substantially surrounds a threaded portion of the threaded adjustment pin to protect the threaded portion against weather related corrosion, wherein the adjustment housing includes a first unthreaded portion and a second unthreaded portion, wherein the threaded portion of the adjustment housing is disposed in a space between the first unthreaded portion and the second unthreaded portion.

2. The hinge arrangement of claim 1 wherein the mount plate portion of the first hinge plate assembly is connected to a gate post and the mount plate portion of the second hinge plate assembly is connected to a gate.

3. The hinge arrangement of claim 1 wherein an end of the threaded adjustment pin terminates within the second unthreaded portion the adjustment housing.

4. The hinge arrangement of claim 1 wherein sufficient relative rotation between the threaded adjustment pin and the threaded portion of the adjustment housing causes the first hinge plate assembly to detach from the second hinge plate assembly.

5. The hinge arrangement of claim 1 wherein the threaded adjustment pin has an elongated axis about which the threaded adjustment pin does not rotate, the threaded portion of the adjustment housing is rotatable about the elongated axis for purpose of adjustment.

6. The hinge arrangement of claim 5 wherein the threaded portion of the adjustment housing comprises a nut of the adjustment housing.

7. The hinge arrangement of claim 6 wherein the first and second unthreaded portions of the adjustment housing are fixed.

8. The hinge arrangement of claim 7 wherein at least one of the first and second unthreaded portions of the adjustment housing includes a slot to enable viewing of the adjustment pin within the adjustment housing.

9. The hinge arrangement of claim 6 wherein the nut includes a tool interface feature to facilitate rotation.

10. The hinge arrangement of claim 6 wherein the nut includes a plurality of spaced apart slots disposed around a periphery of the nut for receiving a flat-head screwdriver to enable rotation of the nut.

11. The hinge arrangement of claim 1 wherein the pivot housing includes upper and lower support structures that extend respectively along upper and lower portions of the adjustment housing.

12. The hinge arrangement of claim 11 wherein the upper and lower support structures define respective upper and lower flats that face the adjustment housing, and the upper and lower portions of the adjustment housing include respective corresponding flats that face the upper and lower flats.

13. The hinge arrangement of claim 1 wherein a connection between the pivot housing and the first hinge plate assembly includes a gravity hinge feature.

14. The hinge arrangement of claim 13 wherein the gravity hinge feature comprises interacting cam surfaces of the pivot housing and the hinge plate assembly.

15. The hinge arrangement of claim 13 wherein the connection between the pivot housing and the first hinge plate assembly includes at least one gravity detent feature for holding the hinge in at least one open position.

16. The hinge arrangement of claim 1 wherein a frictional interference is provided between the threads of the adjustment pin and the threads of the threaded portion of the adjustment housing.

17. The hinge arrangement of claim 1 wherein the first hinge plate assembly includes at least one protruding feature for locating the first hinge plate assembly at a corner of a first structure, and the second hinge plate assembly includes at least one protruding feature for locating the second hinge plate assembly at a corner of a second structure.

18. The hinge arrangement of claim 1 wherein the second hinge plate assembly can rotate slightly relative to the first hinge plate assembly to permit a degree of tilt compensation.

19. A hinge arrangement, comprising:

a first hinge plate assembly including a pivot housing thereon movable about a pivot axis, the pivot housing including a threaded adjustment pin extending in a direction transverse to the pivot axis away from the pivot housing;

a second hinge plate assembly including an adjustment housing thereon, the adjustment housing including a threaded portion;

wherein the threaded adjustment pin is threaded into the adjustment housing to connect the first hinge plate assembly to the second hinge plate assembly, wherein relative rotation between the threaded adjustment pin and the threaded portion of the adjustment housing causes the second hinge plate assembly to move along a length of the threaded adjustment pin thereby altering a spacing between a mount plate portion of the first hinge plate assembly and a mount plate portion of the second hinge plate assembly;

wherein a portion of the threaded adjustment pin extending between the pivot housing and the adjustment housing is unthreaded and the adjustment housing substantially surrounds a threaded portion of the threaded adjustment pin to protect the threaded portion against weather related corrosion; and wherein a connection between the pivot housing and the first hinge plate assembly includes a spring bias feature for urging the hinge arrangement into a closed position.

20. The hinge arrangement of claim 19 wherein the spring bias feature includes a spring and an associated bias adjustment mechanism.

21. A hinge arrangement, comprising:

a first hinge plate assembly including a pivot housing thereon movable about a pivot axis, the pivot housing including a threaded adjustment pin extending in a direction transverse to the pivot axis away from the pivot housing;

a second hinge plate assembly including an adjustment housing thereon, the adjustment housing including a threaded portion;

wherein the threaded adjustment pin is threaded into the adjustment housing to connect the first hinge plate assembly to the second hinge plate assembly, wherein relative rotation between the threaded adjustment pin and the threaded portion of the adjustment housing causes the second hinge plate assembly to move along a length of the threaded adjustment pin thereby altering a spacing between a mount plate portion of the first hinge plate assembly and a mount plate portion of the second hinge plate assembly;

wherein a portion of the threaded adjustment pin extending between the pivot housing and the adjustment housing is unthreaded and the adjustment housing substantially surrounds a threaded portion of the threaded adjustment pin to protect the threaded portion against weather related corrosion;

wherein the second hinge plate assembly can rotate slightly relative to the first hinge plate assembly to permit a degree of tilt compensation; and wherein the pivot housing includes at least one support structure that extends alongside the adjustment housing, and the support structure interacts with the second hinge plate assembly to limit the degree of tilt compensation.

22. A hinge arrangement, comprising:

a first hinge plate assembly including a pivot housing thereon movable about a pivot axis, the pivot housing including a threaded adjustment pin extending in a direction transverse to the pivot axis away from the pivot housing;

a second hinge plate assembly including an adjustment housing thereon, the adjustment housing including a threaded portion;

wherein the threaded adjustment pin is threaded into the adjustment housing to connect the first hinge plate assembly to the second hinge plate assembly, wherein relative rotation between the threaded adjustment pin and the threaded portion of the adjustment housing causes the second hinge plate assembly to move along a length of the threaded adjustment pin thereby altering a spacing between a mount plate portion of the first hinge plate assembly and a mount plate portion of the second hinge plate assembly; and wherein the pivot housing includes upper and lower support structures that extend respectively along upper and lower portions of the adjustment housing.

23. The hinge arrangement of claim 22 wherein the upper and lower support structures comprise respective stabilizing plates that define respective upper and lower flats that face the adjustment housing, and the upper and lower portions of the adjustment housing include respective corresponding flats that face the upper and lower flats.

24. The hinge arrangement of claim 23 wherein a connection between the pivot housing and the first hinge plate assembly includes a gravity hinge feature and at least one gravity detent feature for holding the hinge in at least one open position.

25. A hinge arrangement, comprising:

a first hinge plate assembly including a pivot housing thereon movable about a pivot axis, the pivot housing including a threaded adjustment pin extending in a direction transverse to the pivot axis away from the pivot housing;

a second hinge plate assembly including an adjustment housing thereon, the adjustment housing including a threaded portion;

wherein the threaded adjustment pin is threaded into the adjustment housing to connect the first hinge plate assembly to the second hinge plate assembly, wherein relative rotation between the threaded adjustment pin and the threaded portion of the adjustment housing causes the second hinge plate assembly to move along a length of the threaded adjustment pin thereby altering a spacing between a mount plate portion of the first hinge plate assembly and a mount plate portion of the second hinge plate assembly;

wherein the threaded adjustment pin has an elongated axis about which the threaded adjustment pin does not rotate, the threaded portion of the adjustment housing is rotatable about the elongated axis for purpose of adjustment wherein the threaded portion of the adjustment housing comprises a nut and wherein the nut includes a plurality of spaced apart slots disposed around a periphery of the nut for receiving a flat-head screwdriver to enable rotation of the nut.

26. A hinge arrangement, comprising:

a first hinge plate assembly including a pivot housing thereon movable about a pivot axis, the pivot housing including a threaded adjustment pin extending in a direction transverse to the pivot axis away from the pivot housing;

a second hinge plate assembly including an adjustment housing thereon, the adjustment housing including a threaded portion;

wherein the threaded adjustment pin is threaded into the adjustment housing to connect the first hinge plate assembly to the second hinge plate assembly, wherein relative rotation between the threaded adjustment pin and the threaded portion of the adjustment housing causes the second hinge plate assembly to move along a length of the threaded adjustment pin thereby altering a spacing between a mount plate portion of the first hinge plate assembly and a mount plate portion of the second hinge plate assembly; and wherein the first hinge plate assembly includes at least one protruding feature for locating the first hinge plate assembly at a corner of a first structure, and the second hinge plate assembly includes at least one protruding feature for locating the second hinge plate assembly at a corner of a second structure.

* * * * *